US007271770B2

(12) United States Patent
Washiro

(10) Patent No.: US 7,271,770 B2
(45) Date of Patent: Sep. 18, 2007

(54) REVERSE F-SHAPED ANTENNA

(75) Inventor: Takanori Washiro, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/058,001

(22) Filed: Feb. 15, 2005

(65) Prior Publication Data

US 2005/0190109 A1 Sep. 1, 2005

(30) Foreign Application Priority Data

Mar. 1, 2004 (JP) ..... 2004-056377

(51) Int. Cl.
*H01Q 1/24* (2006.01)

(52) U.S. Cl. ..... 343/702; 343/700 MS

(58) Field of Classification Search ..... 343/700 MS, 343/702, 895, 795
See application file for complete search history.

(56) References Cited

U.S. PATENT DOCUMENTS

| | | | | |
|---|---|---|---|---|
| 6,147,652 | A * | 11/2000 | Sekine | 343/702 |
| 6,239,753 | B1 * | 5/2001 | Kado et al. | 343/702 |
| 6,252,552 | B1 * | 6/2001 | Tarvas et al. | 343/702 |
| 6,380,903 | B1 * | 4/2002 | Hayes et al. | 343/725 |
| 6,642,895 | B2 * | 11/2003 | Zurcher et al. | 343/718 |
| 7,034,750 | B2 * | 4/2006 | Asakura et al. | 343/702 |
| 2002/0024466 | A1 * | 2/2002 | Masuda | 343/700 MS |
| 2003/0038750 | A1 * | 2/2003 | Chen | 343/700 MS |
| 2003/0098813 | A1 * | 5/2003 | Koskiniemi et al. | 343/702 |
| 2003/0112188 | A1 * | 6/2003 | Bordi et al. | 343/702 |
| 2003/0160728 | A1 * | 8/2003 | Fukushima et al. | 343/702 |
| 2003/0193438 | A1 * | 10/2003 | Yoon | 343/702 |
| 2004/0056808 | A1 * | 3/2004 | Jenwatanavet | 343/702 |
| 2004/0207557 | A1 * | 10/2004 | Chen et al. | 343/702 |
| 2006/0001573 | A1 * | 1/2006 | Kim et al. | 343/702 |

FOREIGN PATENT DOCUMENTS

| | | |
|---|---|---|
| JP | 05-191126 | 7/1993 |
| JP | 10-041741 A | 2/1998 |
| JP | 2001-185938 A | 7/2001 |
| JP | 2002-124812 A | 4/2002 |

* cited by examiner

*Primary Examiner*—Trinh Dinh
*Assistant Examiner*—Tung Le
(74) *Attorney, Agent, or Firm*—Lerner, David, Littenberg, Krumholz & Mentlik, LLP

(57) ABSTRACT

In a reverse F-shaped antenna formed on a surface of a printed board, the radiating element has a first radiating conductor, a second radiating conductor, and a chip coil. The chip coil is positioned between the first and second radiating conductors and electrically connects the first radiating conductor to the second radiating conductor. The reverse F-shaped antenna is effectively downsized. A component of current flow in the chip coil in a three-dimensional direction allows sensitivity to some extent to a wave polarized in all directions. By merely changing the inductance in the chip coil, it is possible to easily alter the resonance frequency in the reverse F-shaped antenna.

3 Claims, 4 Drawing Sheets

REVERSE F-SHAPED ANTENNA

CROSS-TO RELATED APPLICATIONS

The present application claims priority from Japanese Application No. 2004-056377, filed Mar. 1, 2004.

BACKGROUND OF THE INVENTION

The present invention relates to an antenna device. It more particularly relates to a reverse F-shaped antenna formed on a surface of a printed board.

Various configurations of small-sized antenna systems suitable for use in mobile communication terminals and so on have been conventionally proposed. In such small-sized antenna systems, a reverse F-shaped antenna has been well known.

FIG. 1 is a diagram illustrating the configuration of a conventional reverse F-shaped antenna. The reverse F-shaped antenna is fed with power through an unbalanced circuit.

As shown in FIG. 1, the reverse F-shaped antenna comprises a radiating element (an exciting element) 5, a grounding element 6, and an RF connector 7 functioning as a feeding point for feeding power to the feeder 5*c* of the radiating element 5. The radiating element 5 includes a radiating conductor 5*a*, a short circuit conductor 5*b*, and a feeder 5*c*. A grounding terminal 7*b* of the RF connector 7 is connected to the grounding element 6.

Such reverse F-shaped antenna 1 is designed so that an impedance matching between a feeding line, such as coaxial cable 8, connected to the feeding point and the radiating element 5 may be obtained by changing the position of the feeding point.

However, the downsizing of wireless communication terminal bodies according to the recent population of mobile communication terminals and the downsizing of antenna modules are accelerating. This requires reverse F-shaped antennas in which the grounding element is incorporated into the antenna to be downsized. It is thus necessary to shorten the radiating element of the antenna.

Further, since radiating elements are printed on and formed in the same plane in the conventional reverse F-shaped antenna, electric current can flow only in the plane so that the antenna is less sensitive to waves polarized vertically relative to the plane.

In the conventional reverse F-shaped antenna, a resonance frequency is determined based on the length of the radiation member formed on the substrate. Thus, if any change in the frequency is required, it is necessary to redesign a separate substrate so that the length of the radiation member can be newly determined.

Alternatively, an array antenna by which dual frequencies can be shared using an inductor has also been proposed.

In this shared antenna, two feeding lines printed and formed on a surface and a back surface of the dielectric substrate, respectively, a pair of inner and outer radiating elements each of which is connected to each of the feeding lines, and an inductor positioned in the space between the inner and outer radiating elements to connect the elements are provided.

This allows the antenna to operate at a frequency f1, about a quarter of a wavelength of which is equal to the total length of the inductor and the inner and outer radiating elements. This also allows it to operate at a frequency f2, about a quarter of a wavelength of which is equal to the length of the inner radiating element, the frequency f2 being significantly higher than the frequency f1, by making the resonance frequency of a parallel circuit constituting a capacitor based on an effect of capacitance in the space and the inductor identical with the frequency f2.

Thus, in the above case, the antenna may operate at two different frequencies. However, since an inductor is positioned at the middle of the radiating elements, only a small amount of the downsizing effect of the radiating elements for the antenna can be realized.

What is needed is to provide an effectively downsized reverse F-shaped antenna having improved antenna properties.

SUMMARY OF THE INVENTION

According to one embodiment of the present invention, there is provided a reverse F-shaped antenna formed on a surface of a printed board. The antenna includes a grounding element, a radiating element located at a position opposed to the grounding element, a short circuit conductor operable to connect the grounding element to the radiating element, and a feeder operable to feed power to the radiating element.

The radiating element includes a first radiating conductor, a second radiating conductor, and at least one conducting device having a helical structure. The first radiating conductor has a first end connected to the short circuit conductor and a second end connected to the feeder. The second radiating conductor is positioned away from the first radiating conductor by a predetermined distance along an extension from the second end of the first radiating conductor. The at least one conducting device is positioned between the first and second radiating conductors to electrically connect the first radiating conductor to the second radiating conductor.

The at least one conducting device may include a chip coil. The second radiating conductor may include a first sub-part positioned relatively close to the first radiating conductor, and a second sub-part positioned further from the first radiating conductor than the first sub-part. The first sub-part has a width and the second sub-part has a width which is larger than the width of the first sub-part.

Alternatively, according to another embodiment of the invention, there is provided a reverse F-shaped antenna formed on a surface of a printed board. The antenna includes a grounding element, a radiating element located at a position opposed to the grounding element, a short circuit conductor operable to connect the grounding element to the radiating element, and a feeder operable to feed power to the radiating element.

The radiating element includes a first radiating conductor, a second radiating conductor, and at least one conducting device having a meandering structure. The first radiating conductor has a first end connected to the short circuit conductor and a second end connected to the feeder. The second radiating conductor is positioned away from the first radiating conductor by a predetermined distance along an extension from the first radiating conductor. The at least one conducting device is positioned between the first and second radiating conductors to electrically connect the first radiating conductor to the second radiating conductor.

In the embodiments of the present invention, in a reverse F-shaped antenna formed on a surface of a printed board, the radiating element has two parts such as a first radiating conductor and a second radiating conductor. The first radiating conductor has a first end connected to the short circuit conductor and a second end connected to the feeder. The second radiating conductor is positioned away from the first radiating conductor by a predetermined distance along an extension from the second end of the first radiating conductor. At least one conducting device having a helical or a meandering structure is positioned between the first and second radiating conductors to electrically connect the first radiating conductor to the second radiating conductor.

Thus, the radiating element includes a radiation conductor pattern and a conducting device having a helical or meandering structure, and has an electric length corresponding to the wavelength of a desired frequency as a whole. Further, the conducting device having the helical or meandering structure is located at a position that is near to the feeder. This allows the reverse F-shaped antenna to be effectively downsized. Using off-the-shelf parts such as a chip coil allows the downsized reverse F-shaped antenna to be manufactured at a low price.

Since the chip coil includes a conducting member having a solid configuration within its main body, a component of current flow in the chip coil in a three-dimensional direction occurs. This allows sensitivity to a wave polarized in all directions to be obtained to some extent.

In the foregoing embodiments, a chip coil is used and by changing the total length of the conducting member inside the chip coil, namely, by merely changing the inductance of the chip coil, it is possible to adjust the length of the radiating element, thereby permitting the resonance frequency in the reverse F-shaped antenna to be easily adjusted.

In the foregoing embodiments, plural chip coils may be used and any desired inductance values of the chip coils are given by a combination thereof so that off-the-shelf chip coils may be used, thereby minimizing the costs of the reverse F-shaped antenna.

According to the invention, in the reverse F-shaped antenna formed on a surface of a printed board, the radiating element has a first radiating conductor having a first end connected to the short circuit conductor and a second end connected to the feeder, and a second radiating conductor positioned away from the first radiating conductor by a predetermined distance along an extension from the second end of the first radiating conductor. At least one conducting device having a helical or a meandering structure is positioned between the first and second radiating conductors to electrically connect the first radiating conductor to the second radiating conductor. This allows the properties of the antenna to be improved and the antenna to be effectively downsized.

The concluding portion of this specification particularly points out and directly claims the subject matter of the present invention. However, those skilled in the art will best understand both the structure and method of operation of the invention, together with further advantages and objects thereof, by reading the remaining portions of the specification in view of the accompanying drawings wherein like reference characters refer to like elements.

DETAILED DESCRIPTION

Figure 1:
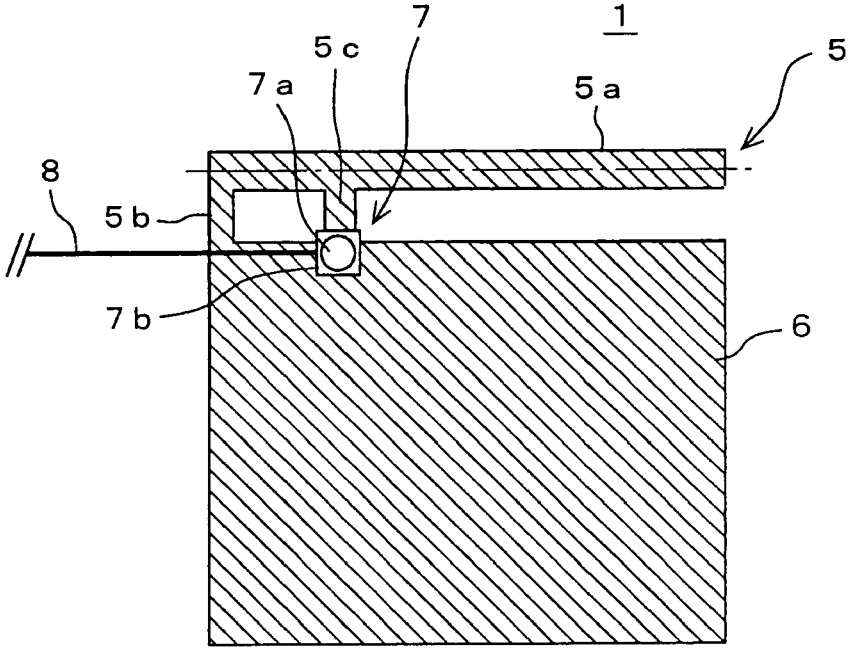
FIG. 1 is a diagram illustrating the configuration of a conventional reverse F-shaped antenna.
Figure 2:
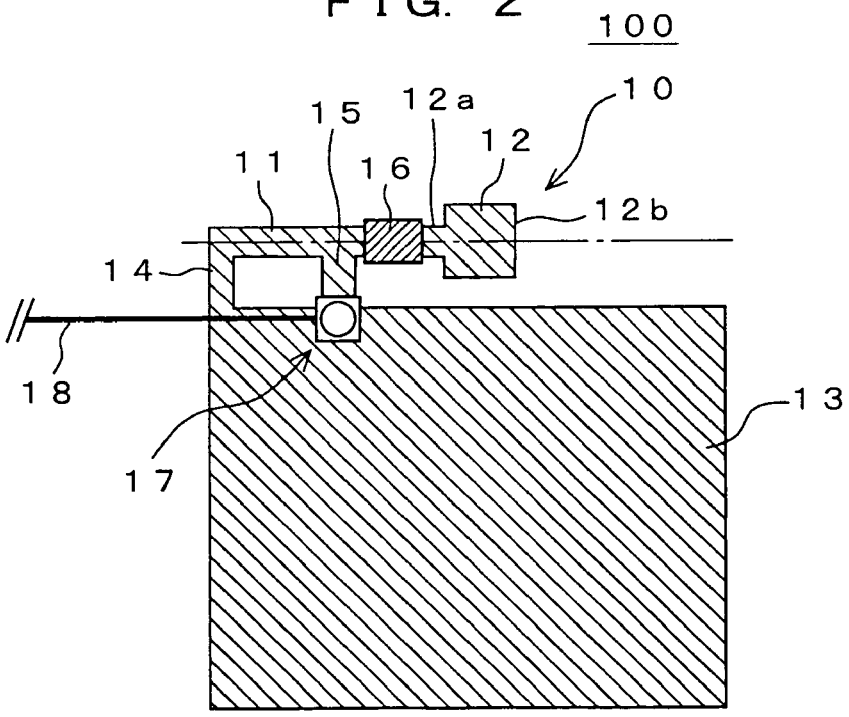
FIG. 2 is a diagram illustrating the configuration of a first embodiment of a reverse F-shaped antenna according to the invention.

Referring to the drawings, the invention will now be described in detail with reference to embodiments of a reverse F-shaped antenna according to the invention. FIG. 2 illustrates the configuration of a first embodiment of the reverse F-shaped antenna 100 according to the invention. As shown in FIG. 2, the reverse F-shaped antenna 100 comprises a first radiating conductor 11, a second radiating conductor 12, a grounding element 13, a short circuit conductor 14, a feeder 15, and a chip coil 16 having a helical structure.

The first radiating conductor 11 includes a pattern formed on the surface of a substrate by any method, such as etching. The first radiating conductor 11 has one end connected to the short circuit conductor 14 and a second end connected to the feeder 15.

The second radiating conductor 12 includes a pattern that is formed on the surface of a substrate using any method, such as etching, so that it is away from the first radiating conductor 11 by a predetermined distance along an extension from the second end of the first radiating conductor 11. The second radiating conductor 12 includes a first sub-part 12*a*, which is near to the first radiating conductor 11, and a second sub-part 12*b*, which is further from the first radiating conductor 11 than the first sub-part 12*a*. The second sub-part 12*b* has a wider width than the width of the first sub-part 12*a*.

Thus, when a forward end of the radiating element has a wider capacitance load part, the amount of current flow through the chip coil 16 increases as compared with the case in which such capacitance load part is not provided, thereby obtaining an excellent effect on downsizing of the antenna. In other words, if antennas having the same resonance frequency are made, a chip coil having a smaller amount of inductance can be used. Since a chip coil having a smaller amount of inductance gives a smaller direct current resistance as compared with a chip coil having a larger amount of inductance, power lost as heat in the antenna decreases, thereby enhancing the radiation gain of the antenna. A chip coil having a smaller amount of inductance has a high self-resonance frequency for exercising stable antenna properties, even at high frequency.

The first radiating conductor 11 and the second radiating conductor 12 are designed as to fix the chip coil 16 on the substrate in addition to radiating electric waves. This allows the reverse F-shaped antenna 100 to be produced without using any other reinforcing jig member.

The ratio of the length of the first radiating conductor 11 to that of the second radiating conductor 12 is determined by input impedance to the reverse F-shaped antenna 100. For example, if the impedance is 50 Ω, the second radiating conductor 12 is longer than the first radiating conductor 11. In this case, it is practical on downsizing of the antenna to shorten the second radiating conductor 12 as compared to the case where the first radiating conductor 11 is shortened.

The grounding element 13 is formed on a substrate on which a receiving circuit and the like are set or a substrate for the reverse F-shaped antenna's exclusive use. In this embodiment, it is formed on a substrate for the reverse F-shaped antenna's exclusive use. If receiving or sending a signal, a current flows through even the grounding element 13 so that it is shared with the operation of the reverse F-shaped antenna 100 as a part thereof. The size and/or shape of the grounding element 13 affects the properties of the reverse F-shaped antenna 100.

The short circuit conductor 14 includes a pattern formed on the substrate to connect the first radiating conductor 11 and the grounding element 13 with each other.

The feeder 15 includes a pattern formed on the substrate to connect the grounding element 13 with the first radiating conductor 11 at its end opposed to the end of the first radiating conductor 11 to which the short circuit conductor 14 is connected. The feeder 15 is provided with an RF connector 17 for connecting the antenna with an RF circuit (receiving or transmitting circuit) via a coaxial cable 18. The RF circuit feeds power to the reverse F-shaped antenna 100 via the RF connector 17.

The chip coil 16 has conducting member(s) folded in a helical fashion in it or on its surface. Herein, it is conceivable that the helical conducting member is a solid spring coil or a two-dimensional scroll conductor. The chip coil 16 may be provided as a wire type coil, a laminate type coil, a film type coil, or the like.

Figure 3A:
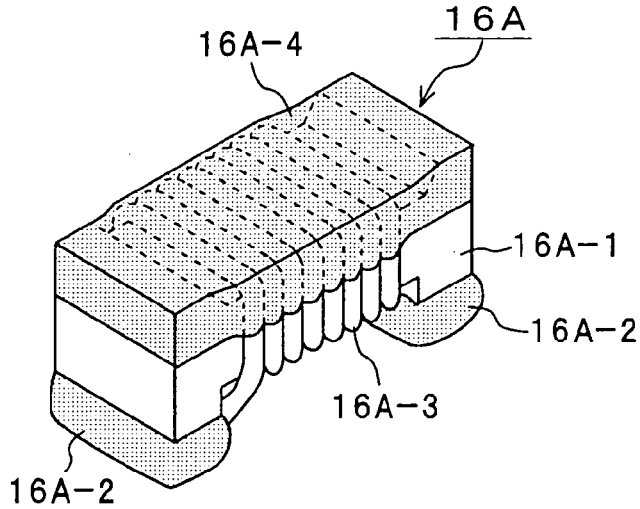
FIGS. 3A through 3C are diagrams each illustrating the configuration of a chip coil.
Figure 3B:
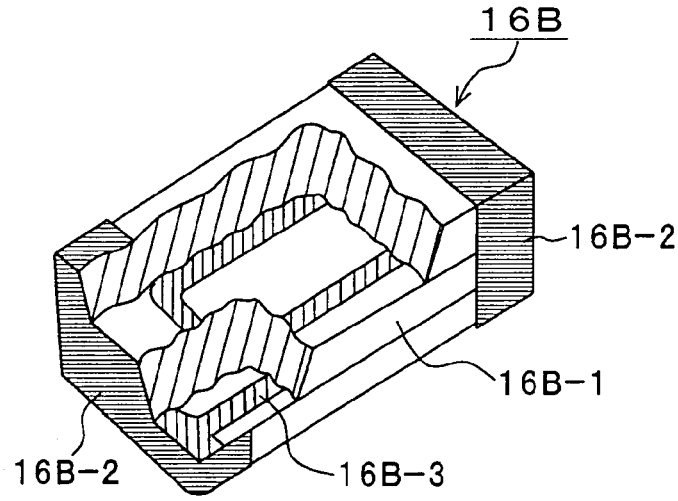
Figure 3C:
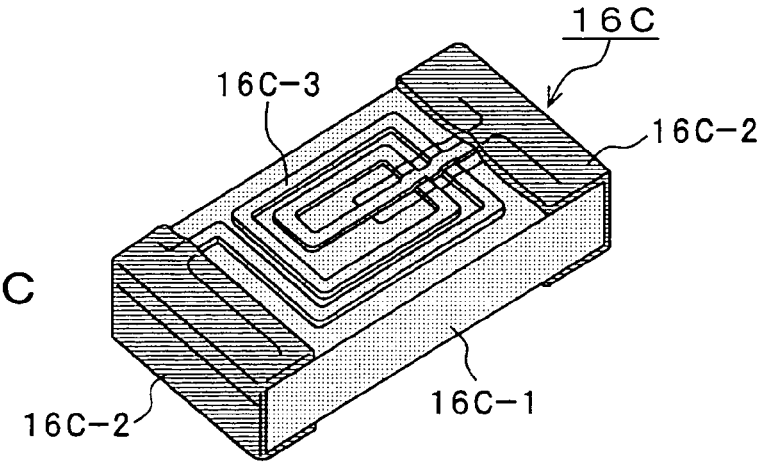

FIG. 3A is a diagram illustrating the inner configuration of a wire type chip coil 16A; FIG. 3B is a diagram illustrating the inner configuration of a laminate type chip coil 16B; and FIG. 3C is a diagram illustrating the inner configuration of a film type chip coil 16C. As shown in FIGS. 3A through 3C, the chip coils 16A through 16C having different helical structures have such a configuration that a conducting member can be set in their main bodies, respectively, in a three-dimensional manner.

The wire type chip coil 16A comprises a core 16A-1 of alumina, electrodes 16A-2, a wire 16A-3 for winding the core, and a plastic coating layer 16A-4 coated on the core 16A-1 and the wire 16A-3.

The laminate type chip coil 16B comprises plural plates 16B-1 of glass ceramics and electrodes 16B-2. A coil pattern 16B-3 is printed on each plate. The plural plates 16B-1 are laminated so that they are integrated with each other, and thus, the electrodes 16B-2 are attached to both ends of the integrated structure.

The film type chip coil 16C comprises a substrate 16C-1 of ceramics and electrodes 16C-2. A coil pattern 16C-3 is sputtered on the substrate 16C-1. The electrodes 16C-2 are attached to both ends of the substrate 16C-1.

The lower the frequency of an electric wave, the longer will be its wavelength. Thus, an antenna operating at a lower frequency has a larger sized radiating element. A high-frequency signal may be combined through electric and/or magnetic fields leaked around an electric line even if the line is not actually connected so that the physical length of the radiating element is generally different from the electric length thereof when a signal is being transferred. A length including such electric combination and/or any interaction therebetween, not the physical length of the radiating element, is referred to as "an actual electric length". Thus, the physical length does not always correspond to the electric length thereof, but the longer the physical length is, the longer the electric length will be. This allows the antenna to be downsized by folding and bending the radiating conductor of the antenna many times to make it longer. In this case, using a conducting member in each of the chip coils 16 shown in FIG. 3A through 3C as a part of the radiating conductor of the antenna allows an antenna having a longer electric length of the radiating element to be produced at a low cost, thereby permitting the radiating element 10 of the reverse F-shaped antenna 100 to be shortened, namely, to be downsized.

According to this embodiment, the radiating element of the reverse F-shaped antenna includes a first radiating conductor 11, a second radiating conductor 12, and the chip coil 16. The first radiating conductor 11 has one end connected to the short circuit conductor 14 and the second end thereof connected to the feeder 15. The second radiating conductor 12 is formed away from the first radiating conductor 11 by a predetermined distance along an extension from the second end of the first radiating conductor 11. The chip coil 16 is positioned between the first and second radiating conductors 11 and 12 to allow the first and second radiating conductors 11 and 12 to be electrically connected with each other by the chip coil 16.

Thus, the radiating element 10 has an electric length corresponding to the wavelength of a desired frequency as a whole. Further, the chip coil 16 is positioned at a position that is near to the feeder 15. This allows the reverse F-shaped antenna to be effectively downsized.

Using off-the-shelf parts such as a chip coil allows the downsized reverse F-shaped antenna to be manufactured at a low price.

Since a chip coil 16 is used in which the conducting member(s) is (are) configured in a three-dimensional manner within its main body, a component of current flow in the chip coil 16 occurs in a three-dimensional direction. This allows the antenna to be sensitive to some extent to a wave polarized in all directions.

In this embodiment, the chip coil 16 is used and thus, by merely changing the inductance of the chip coil 16 to change the length of radiating element 10, it is possible to easily alter the resonance frequency in the reverse F-shaped antenna 100.

Figure 4:
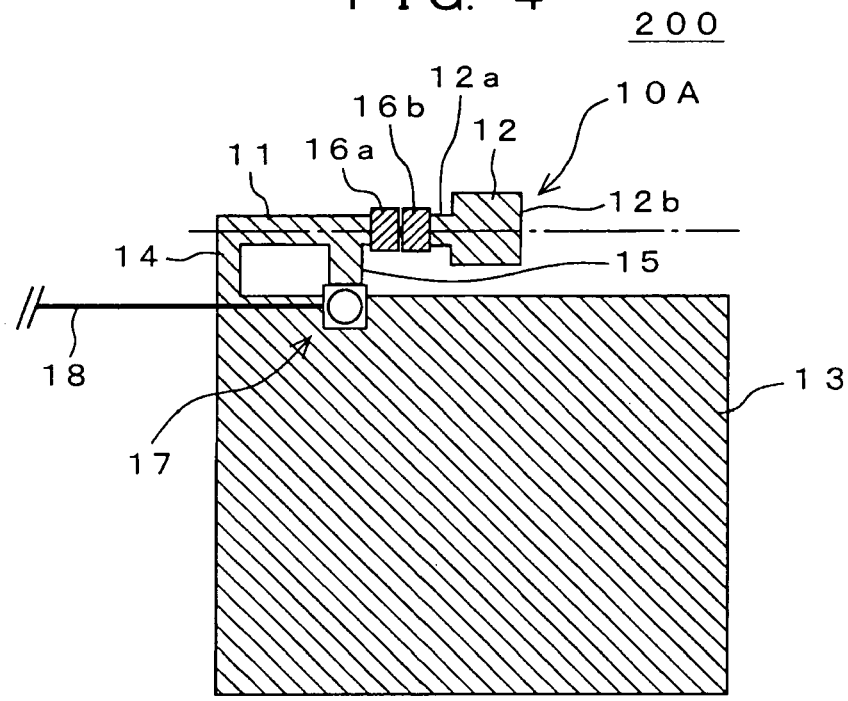
FIG. 4 is a diagram illustrating the configuration of a second embodiment of a reverse F-shaped antenna according to the invention.

FIG. 4 illustrates the configuration of a second embodiment of the reverse F-shaped antenna 200 according to the invention. The reverse F-shaped antenna 200 uses plural chip coils. In the embodiment shown in FIG. 4, like members corresponding to those shown in FIG. 2 are indicated by like reference numbers, and descriptions thereof are omitted.

As shown in FIG. 4, the reverse F-shaped antenna 200 comprises a first radiating conductor 11, a second radiating conductor 12, a grounding element 13, a short circuit conductor 14, a feeder 15, and chip coils 16*a* and 16*b* each having a helical structure.

The first radiating conductor 11 includes a pattern formed on the surface of a substrate by any method, such as etching. The first radiating conductor 11 has one end connected to the short circuit conductor 14 and a second end connected to the feeder 15.

The second radiating conductor 12 includes a pattern that is formed on the surface of a substrate using any method, such as etching, so that it is away from the first radiating conductor 11 by a predetermined distance along an extension from the second end of the first radiating conductor 11.

Thus, when a forward end of the radiating element has a wider capacitance load part, the amount of current flow through the chip coils 16*a*, 16*b* increases as compared with the case where such capacitance load part is not provided, thereby obtaining an excellent effect on downsizing of the antenna. In other words, if antennas having the same resonance frequency are made, a chip coil having a smaller amount of inductance can be used. Since a chip coil having a smaller amount of inductance gives a smaller direct current resistance as compared with a chip coil having a larger amount of inductance, power lost as heat in the antenna decreases, thereby enhancing the radiation gain of the antenna. A chip coil having a smaller amount of inductance has a high self-resonance frequency for exercising stable antenna properties, even at high frequency.

The first radiating conductor 11 and the second radiating conductor 12 are designed as to fix the chip coils 16*a*, 16*b* on the substrate in addition to radiating electric waves. This allows the reverse F-shaped antenna 200 to be produced without using any other reinforcing jig member.

Each of the chip coils 16*a*, 16*b* has conducting member(s) folded in a helical fashion in it or on its surface. Herein, it is conceivable that the helical conducting member is a solid spring coil or a two-dimensional scroll conductor. The chip coils 16*a*, 16*b* may be provided as wire type coils, laminate type coils, film type coils, or the like (see FIGS. 3A through 3C).

As shown in FIG. 4, the chip coils 16*a*, 16*b* are connected in series between the first and second radiating conductors 11, 12. Setting the chip coils 16*a*, 16*b* on a part of radiating element 10A where a large amount of current flows allows the radiating element 10A to be more significantly downsized.

According to this embodiment, the radiating element 10A of the reverse F-shaped antenna 200 includes a first radiating conductor 11, a second radiating conductor 12, and the chip coils 16*a*, 16*b*. The first radiating conductor 11 has one end connected to the short circuit conductor 14 and the second end thereof connected to the feeder 15. The second radiating conductor 12 is formed away from the first radiating conductor 11 by a predetermined distance along an extension from the second end of the first radiating conductor 11. The chip coils 16*a*, 16*b* are positioned between the first and second radiating conductors 11 and 12 to allow the first and second radiating conductors 11 and 12 to be electrically connected with each other by the chip coils 16*a*, 16*b*.

Thus, the radiating element 10A has an electric length corresponding to the wavelength of a desired frequency as a whole. Further, the chip coils 16*a*, 16*b* are positioned at positions that are near to the feeder 15. This allows the reverse F-shaped antenna 200 to be effectively downsized.

Since each of the chip coils 16*a*, 16*b* used has the conducting member(s) configured in a three-dimensional manner within its main body, a component of current flow in the chip coils 16*a*, 16*b* occurs in a three-dimensional direction. This allows the antenna to be sensitive to some extent to a wave polarized in all directions.

In this embodiment, the chip coils 16*a*, 16*b* are used and thus, by changing the total length of the conducting member in each of the chip coils 16*a*, 16*b*, namely, by merely changing the inductance of the chip coils 16*a*, 16*b* to change the length of the radiating element, it is possible to alter the resonance frequency in the reverse F-shaped antenna 200.

Plural chip coils 16*a*, 16*b* are used and the inductance values of the chip coils are given by any combination thereof so that an off-the-shelf chip coil product can be used, thereby lowering the cost of the reverse F-shaped antenna 200.

Figure 5:
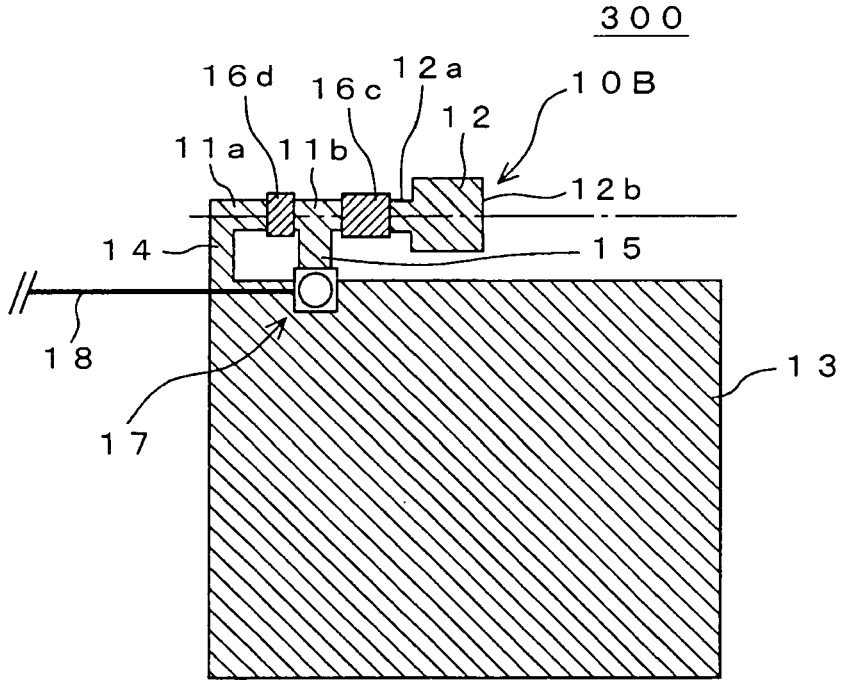
FIG. 5 is a diagram illustrating the configuration of a third embodiment of a reverse F-shaped antenna according to the invention.

FIG. 5 illustrates the configuration of a third embodiment of the reverse F-shaped antenna 300 according to the invention. In the embodiment shown in FIG. 5, like members corresponding to those shown in FIG. 2 are indicated by like reference numbers, and descriptions thereof are omitted.

As shown in FIG. 5, the reverse F-shaped antenna 300 comprises first radiating conductors 11*a* and 11*b*, a second radiating conductor 12, a grounding element 13, a short circuit conductor 14, a feeder 15, and chip coils 16*c* and 16*d* each having a helical structure.

Each of the first radiating conductors 11*a*, 11*b* includes a pattern formed on the surface of a substrate by any method, such as etching. The first radiating conductor 11*a* has one end connected to the short circuit conductor 14 and a second end connected to one end of the chip coil 16*d*. Further, the first radiating conductor 11*b* is connected to the feeder 15 and also to the other end of the chip coil 16*d* as well as one end of the chip coil 16*c*.

The second radiating conductor 12 includes a pattern formed on the surface of a substrate using any method, such as etching, so that it is away from the first radiating conductor 11*b* by a predetermined distance along an extension from the first radiating conductors 11*a*, 11*b*. The second radiating conductor 12 includes a first sub-part 12*a*, which is near to the first radiating conductor 11*b*, and a second sub-part 12*b*, which is further from the first radiating conductor 11*b* than the first sub-part 12*a*. The second sub-part 12*b* has a wider width than the first sub-part 12*a*. Thus, when a forward end of the radiating element 10B has a wider capacitance load part, the amount of current flow through the chip coils 16*c*, 16*d* increases as compared with the case in which such capacitance load part is not provided, thereby obtaining an excellent effect on downsizing of the antenna. In other words, if antennas having the same resonance frequency are made, a chip coil having a smaller amount of inductance can be used. Since a chip coil having a smaller amount of inductance gives a smaller direct current resistance as compared with a chip coil having a larger amount of inductance, power lost as heat in the antenna decreases, thereby enhancing the radiation gain of the antenna. A chip coil having a smaller amount of inductance has a high self-resonance frequency for exercising stable antenna properties, even at high frequency.

The first radiating conductors 11*a*, 11*b* and the second radiating conductor 12 are designed as to fix the chip coils 16*c*, 16*d* on the substrate in addition to radiating electric waves. This allows the reverse F-shaped antenna 300 to be produced without using any other reinforcing jig member.

Each of the chip coils 16*c*, 16*d* has conducting member(s) folded in a helical fashion in it or on its surface. Herein, it is conceivable that the helical conducting member is a solid spring coil or a two-dimensional scroll conductor. The chip coils 16*c*, 16*d* may be provided as wire type coils, laminate type coils, film type coils, or the like (see FIGS. 3A through 3C).

As shown in FIG. 5, the chip coil 16*c* is connected in series between the first radiating conductor 11*b* and the second radiating conductor 12. The chip coil 16*d* is connected in series between the first radiating conductors 11*a* and 11*b*. Setting the chip coils 16*c*, 16*d* on a part of radiating element 10B where a large amount of current flows (the part that is near the feeder 15) allows the radiating element 10B to be more significantly downsized.

According to this embodiment, the radiating element 10B of the reverse F-shaped antenna 300 includes first radiating conductors 11*a* and 11*b*, a second radiating conductor 12, and the chip coils 16*c*, 16*d*. The chip coil 16*c* is positioned between the first radiating conductor 11*b* and the second radiating conductor 12, and the chip coil 16*d* is positioned between the first radiating conductors 11*a* and 11*b*, so that the first radiating conductors 11*a*, 11*b* and the second radiating conductor 12 can be electrically connected with each other by the chip coils 16*c*, 16*d*.

Thus, the radiating element 10B has an electric length corresponding to the wavelength of a desired frequency as a whole. Further, the chip coils 16*c*, 16*d* are positioned at positions that are near to the feeder 15. This allows the reverse F-shaped antenna 300 to be effectively downsized.

Using off-the-shelf parts such as the chip coils 16*c*, 16*d* allows the downsized reverse F-shaped antenna 300 to be manufactured at a low price.

Since each of the chip coils 16*c*, 16*d* used has the conducting member(s) configured in a three-dimensional manner within its main body, a component of current flow in the chip coils 16*c*, 16*d* occurs in a three-dimensional direction. This allows the antenna to be sensitive to some extent to a wave polarized in all directions.

In this embodiment, the chip coils 16*c*, 16*d* are used and thus, by changing the total length of the conducting member in each of the chip coils 16*c*, 16*d*, namely, by merely changing the inductance of the chip coils 16*c*, 16*d* to change the length of the radiating element, it is possible to easily alter the resonance frequency in the reverse F-shaped antenna 300.

The chip coil 16*d* is used so that portions of the first radiating conductors 11*a*, 11*b* of the reverse F-shaped antenna 300 can be also shortened (downsized).

Figure 6:
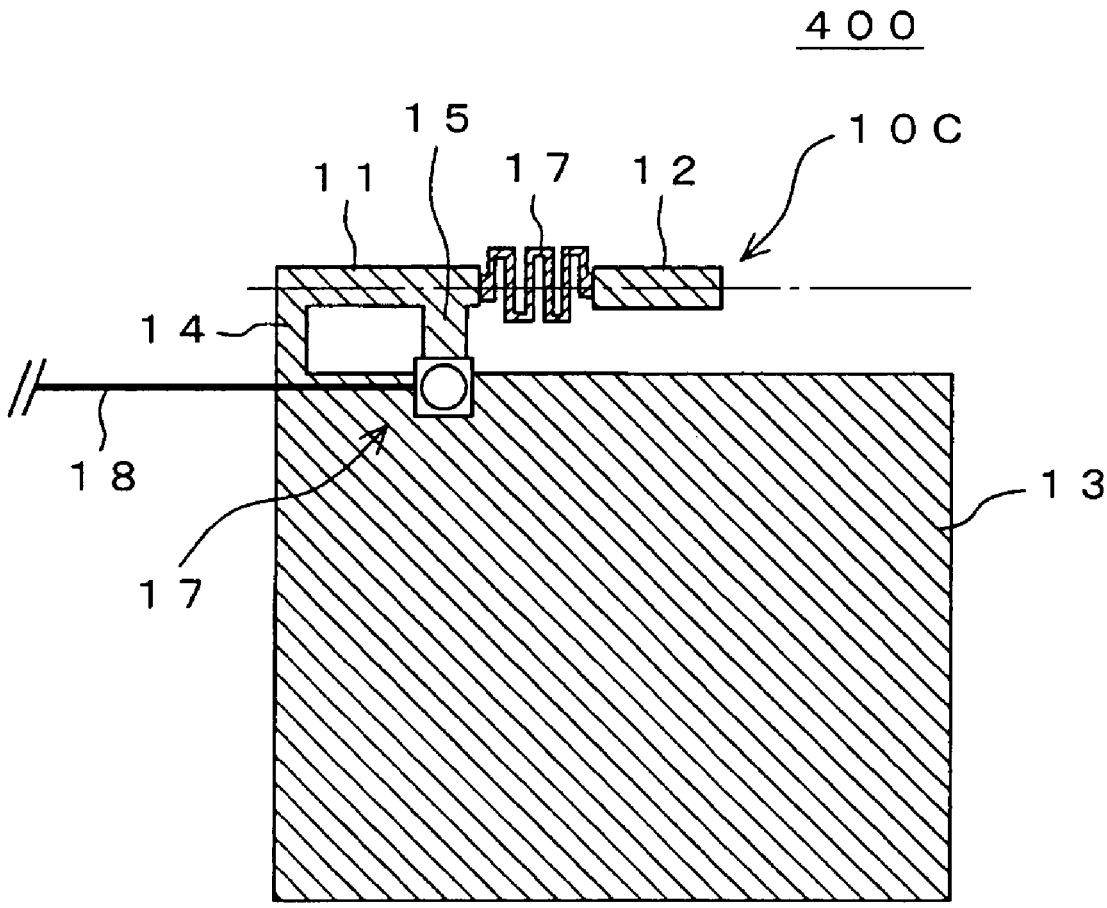
FIG. 6 is a diagram illustrating the configuration of a fourth embodiment of a reverse F-shaped antenna according to the invention.

FIG. 6 illustrates the configuration of a fourth embodiment of the reverse F-shaped antenna 400 according to the invention. In the embodiment shown in FIG. 6, like members corresponding to those shown in FIG. 2 are indicated by like reference numbers, and descriptions thereof are omitted.

As shown in FIG. 6, the reverse F-shaped antenna 400 comprises a first radiating conductor 11, a second radiating conductor 12, a grounding element 13, a short circuit conductor 14, a feeder 15, and a conductor 17 having a meandering structure.

The first radiating conductor 11 includes a pattern formed on the surface of a substrate by any method, such as etching. The first radiating conductor 11 has one end connected to the short circuit conductor 14 and a second end connected to the feeder 15 and to the conductor 17 having the meandering structure.

The second radiating conductor 12 includes a pattern formed on the surface of a substrate using any method, such as etching, so that it is away from the first radiating conductor 11 by a predetermined distance along an extension from the first radiating conductor 11. The second radiating conductor 12 has a uniform width.

The second radiating conductor 12 may be formed with two sub-parts as shown in FIG. 2 so that a sub-part which is near to the first radiating conductor 11 has a narrower width than the other sub-part which is further from the first radiating conductor 11. Thus, when a forward end of the radiating element 10*c* has a wider capacitance load part, the amount of current flow through the conductor 17 increases as compared with the case in which such capacitance load part is not provided, thereby obtaining an excellent effect on downsizing of the antenna.

The conductor 17 having the meandering structure is formed on the surface of a substrate as a zigzag pattern using any method, such as etching. As shown in FIG. 6, the conductor 17 is formed between the first radiating conductor 11 and the second radiating conductor 12 so that it can be connected in series between the conductors 11 and 12.

According to this embodiment, the radiating element 10C of the reverse F-shaped antenna 400 includes a first radiating conductor 11, a second radiating conductor 12, and the conductor 17 having the meandering structure. The conductor 17 is positioned between the first radiating conductor 11 and the second radiating conductor 12 so that the first radiating conductor 11 and the second radiating conductor 12 can be electrically connected with each other by the conductor 17.

Thus, the radiating element 10C includes the conductor 17 having the meandering structure and the conductor 17 is positioned at a position that is near to the feeder 15. This allows the reverse F-shaped antenna 400 to be effectively downsized.

Although the invention has been described in detail with reference to specific embodiments of the invention in the form of an antenna in which chip coils 16, 16*a*, 16*b*, 16*c*, and 16*d* are used as a conductor having a helical structure, this invention is not limited thereto. Any conductor having a helical structure may be used.

Although the invention herein has been described with reference to particular embodiments of the reverse F-shaped antennas, this invention is not limited thereto. This invention may be applied to any other printed antenna. It should be understood that the invention is not limited to the embodiments described and that the invention can be applied equally well to other types of flat antennas printed on a printed board, which are used in small-sized and light weight transmit/receive devices, such as wireless mobile terminals. While the foregoing specification has described preferred embodiment(s) of the present invention, one skilled in the art may make many modifications to the preferred embodiment without departing from the invention in its broader aspects. The appended claims therefore are intended to cover all such modifications as fall within the true scope and spirit of the invention.

What is claimed is:

1. A reverse F-shaped antenna formed on a surface of a printed board, said antenna comprising:

a grounding element;

a radiating element located at a position opposed to the grounding element;

a short circuit conductor operable to connect the grounding element to the radiating element; and a feeder operable to feed power to the radiating element;

wherein the radiating element includes a first radiating conductor, a second radiating conductor, and at least one conducting device having a helical structure, the first radiating conductor having a first end connected to the short circuit conductor and a second end connected to the feeder, the second radiating conductor being positioned away from the first radiating conductor by a predetermined distance along an extension from the second end of the first radiating conductor, the at least one conducting device being positioned between the first and second radiating conductors to electrically connect the first radiating conductor to the second radiating conductor, and the second radiating conductor including a first sub-part positioned relatively close to the first radiating conductor, and a second sub-part positioned farther from the first radiating conductor than the first sub-part, the first sub-part having a width and the second sub-part having a width which is larger than the width of the first sub-part.

2. The reverse F-shaped antenna according to claim 1, wherein the at least one conducting device includes a chip coil.

3. A reverse F-shaped antenna formed on a surface of a printed board, the antenna comprising a grounding element; a radiating element located at a position opposed to the grounding element; a short circuit conductor operable to connect the grounding element to the radiating element; and a feeder operable to feed power to the radiating element; and wherein the radiating element includes a first radiating conductor, a second radiating conductor, and at least one conducting device having a meandering structure, the first radiating conductor having a first end connected to the short circuit conductor and a second end connected to the feeder, the second radiating conductor being positioned away from the first radiating conductor by a predetermined distance along an extension from the second end of the first radiating conductor, the at least one conducting device being positioned between the first and second radiating conductor to the second radiating conductor, and the second radiating conductor including a first sub-part positioned relatively close to the first radiating conductor, and a second sub-part positioned farther from the first radiating conductor than the first sub-part, the first sub-part having a width and the second sub-part having a width which is larger than the width of the first sub-part.

* * * * *

UNITED STATES PATENT AND TRADEMARK OFFICE

CERTIFICATE OF CORRECTION

PATENT NO. : 7,271,770 B2
APPLICATION NO. : 11/058001
DATED : September 18, 2007
INVENTOR(S) : Takanori Washiro It is certified that error appears in the above-identified patent and that said Letters Patent is hereby corrected as shown below:

Column 10, line 65, “comprising a” should read --comprising: a--
Column 11, line 10, “from the second end of the first” should read --from the first--
Column 11, line 11, “conductor, the” should read --conductor, and the--
Column 12, line 1, “radiating conductor to” should read --radiating conductors to--
Column 12, line 2, “the second radiating” should read --electrically connect the first radiating conductor to the second radiating--
Column 12, line 2, “and the second” should read -- and wherein the second--
Column 12, line 3, “conductor including a” should read --conductor includes a--

Signed and Sealed this

Twelfth Day of August, 2008

JON W. DUDAS
*Director of the United States Patent and Trademark Office*